US006602839B2

(12) United States Patent
Smith et al.

(10) Patent No.: US 6,602,839 B2
(45) Date of Patent: Aug. 5, 2003

(54) ADVANCED SULFOSUCCINAMATE SURFACTANTS

(75) Inventors: George A. Smith, Austin, TX (US); Raeda M. Smadi, Austin, TX (US)

(73) Assignee: Huntsman Petrochemical Corporation, Austin, TX (US)

( * ) Notice: Subject to any disclaimer, the term of this patent is extended or adjusted under 35 U.S.C. 154(b) by 140 days.

(21) Appl. No.: 09/754,867

(22) Filed: Jan. 5, 2001

(65) Prior Publication Data

US 2002/0142929 A1 Oct. 3, 2002

(51) Int. Cl.[7] ..... C11D 17/50

(52) U.S. Cl. ..... 510/351; 510/352; 510/424; 510/426; 510/428; 510/492; 510/536

(58) Field of Search ..... 510/492, 536, 510/424, 426, 428, 351, 352

(56) References Cited

U.S. PATENT DOCUMENTS

| | | | | |
|---|---|---|---|---|
| 2,383,130 A | * | 2/1945 | Jaeger et al. | 260/513 |
| 5,480,586 A | | 1/1996 | Jakubicki et al. | 252/545 |
| 2001/0031712 A1 | | 10/2001 | Ziganke et al. | 510/218 |

FOREIGN PATENT DOCUMENTS

| | | |
|---|---|---|
| GB | 1306066 | 2/1953 |
| GB | 1410018 | 10/1975 |
| GB | 2091720 | 8/1982 |

OTHER PUBLICATIONS

Anionic Surfactants: organic chemistry ISBN 0–8247–9394–3 pp. 503–515 *1995 NMA.

"Sulfosuccinate Surfactants" Cosmetics and Toiletries vol. 104, Nov. 1989; pp. 105–112.

Soap–Based Detergent Formulations: VIII. N–Alkylsulfosuccinamates as Lime Soap Dispersants Micich, Linfield, and Weil; Eastern Research Center, Philadelphia, Penn. Nov. 1973.

* cited by examiner

*Primary Examiner*—Necholus Ogden

(74) *Attorney, Agent, or Firm*—Christopher J. Whewell

(57) ABSTRACT

Provided herein are sulfosuccinamates made using polyetheramines as intermediates. The sulfosuccinamates according to the invention exhibit excellent detergency when employed in formulations used as hard surface cleaners, laundry detergents, and dishwashing liquids. In addition, the sulfosuccinamates according to the invention have an unexpectedly high degree of water hardness tolerance, and are easier to produce than similar materials found in the prior art owing to the fact that the product and its intermediates exist in liquid form.

9 Claims, 4 Drawing Sheets

ADVANCED SULFOSUCCINAMATE SURFACTANTS

This invention relates to detergent formulations useful in cleaning a variety of substrates, including without limitation hard surfaces, metals, plastics, glass, laundry, dishes, etc. It also relates to components useful in formulating such detergents, wherein the components are surfactants of the sulfosuccinamate type.

BACKGROUND

Chemical compounds and multi-component formulations containing the same that are useful for removing grease, oils, dirt, and other unwanted matter from various surfaces and objects have been known since early times, and include the simple soaps which are manufactured by oil saponification, a process in which aqueous alkali metal hydroxide is mixed with an ester (such as an animal fat or vegetable oil) to cause its de-esterification and attendant formation of the corresponding alkali salt(s) of the carboxylic acid(s) from which the ester was comprised. Importantly, the anion portions of the water-soluble alkali salts of these carboxylic acid(s) include as part of their molecular structure a polar hydrophilic portion (the carboxylate function) which is highly attracted to and associates well with water molecules. In the same anion, such salts also include a non-polar, hydrophobic portion, which is most often a hydrocarbyl moiety containing between about 12 and 22 carbon atoms per molecule. Such salts are commonly referred to by those skilled in the art as "salts of fatty acids", and by laypersons as "soap". As used in this specification and the appended claims, "hydrocarbyl", when referring to a substituent or group is used in its ordinary sense, which is well-known to those skilled in the art. Specifically, it refers to a group having a carbon atom directly attached to the remainder of the molecule and having predominantly hydrocarbon character. Examples of hydrocarbyl substituents or groups include: (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); (2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy); (3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Aqueous solutions of salts of fatty acids are very effective at causing grease, oils, and other normally water-insoluble materials to become solubilized by the well-known phenomenon of micelle formation, involving the formation of a water-soluble oil/soap complex, and are thus rendered capable of being rinsed away with water, leaving behind a cleaned substrate, whether it be a tabletop, countertop, article of glassware or dinnerware, flatware, objects of art, statues, clothing, architecture, motor vehicles, skin, hair, etc. Factors which are most readily varied in the manufacture of soap include the selection of the particular oil which is to be saponified, as it is well-known that different oils comprise varying amounts of individual components having differing lengths of hydrocarbyl moieties in the finished anion. Thus, an oil may be selected for a specific use.

While the industries for the production of such soaps from fats and oils are well-established, saponification chemists and other workers have continuously sought improved chemistries for rendering materials which are not normally soluble in aqueous media to be rendered soluble therein. Towards this end, a wide variety of materials have been identified by those who have become skilled in such arts, with the common denominator of such materials being that the materials useful as surfactants all contain a hydrophobic portion and a hydrophilic portion in their molecular structures.

One family of materials that have been identified as suitable soap substitutes are the linear alkylbenzene ("LAB") sulfonates. The LAB sulfonates in general are exemplified as comprising a benzene ring structure having both a non-polar hydrocarbyl substituent and a polar sulfonate group bonded to the ring. Factors which are most readily varied in the manufacture of LAB type detergents include the length of the hydrocarbon chain of the alkyl substituent, the positional isomeric relationship between the hydrocarbyl group and the sulfonate group (o, p, m) on the ring, and the location of the point of attachment of the ring to a hydrocarbyl chain substituent, as discussed in U.S. Pat. Nos. 6,133,492; 5,847,254; 5,777,187; and 5,770,782, the contents of each of which are herein incorporated by reference thereto.

Sulfosuccinamides are a well-known class of surfactants which are made by reacting a primary amine with maleic acid anhydride and then sulfonating the resulting product with sulfite ion. Sulfosuccinamides are used in industrial applications. N-tallowyl sulfosuccinamide is used primarily in emulsion polymerization where it imparts small particle and mechanical stability to the latex. Such materials are typically pastes having a 35% actives content in water, which makes them somewhat difficult to handle and process. Sulfosuccinamides are also used as foaming agents in SBR latex for carpet backing and as emulsifying agents for wax and oil polishes. The prior art is relatively devoid of much activity in the area of these types of surfactants.

The general classes of surfactants described above are but three of the thousands of known surfactant materials. In general terms, the selection of a particular surfactant for an intended use will depend upon several factors, such as: cost, effectiveness, compatibility with other materials, toxicity, biodegradability, environmental impact, aesthetics, etc. Thus, the selection of a particular material is based upon an overall favorable mix of several variables, and what may be a preferred material for one given end use is not in all substantial likelihood preferred for a different use. Of the surfactants in the prior art, those which exhibit excellent soil removal, compatibility with a wide range of materials, stability, existence in the liquid state when neat, low streaking, little film formation, and excellent laundry cleaning performance, all at a reasonable cost, are relatively scarce. In accordance with the present invention are provided sulfosuccinamate detergents possessive of all of these properties. Low viscosity, liquid products can be made which have excellent detergency properties and high water hardness tolerance.

SUMMARY OF THE INVENTION

The present invention provides compositions of matter useful as surfactants in finished formulations for cleaning dishes, hard surfaces, and laundry, and other uses which surfactants are known, which comprises an anionic form of a material described by the formula:

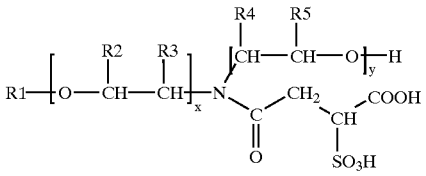

in which R1 is a hydrocarbyl group containing between 5 and 19 carbon atoms, saturated or unsaturated, straight-chain, branched, or cyclic; $R_2$ and $R_3$ may each independently be a hydrogen, or a hydrocarbyl group selected from the group consisting of: methyl and ethyl; x may be any integer between 1 and 20, including 1 and 20; $R_4$ and $R_5$ may each independently be a hydrogen, or a hydrocarbyl group selected from the group consisting of: methyl and ethyl; and y is independently equal to zero or 1.

DETAILED DESCRIPTION

Figure 1:
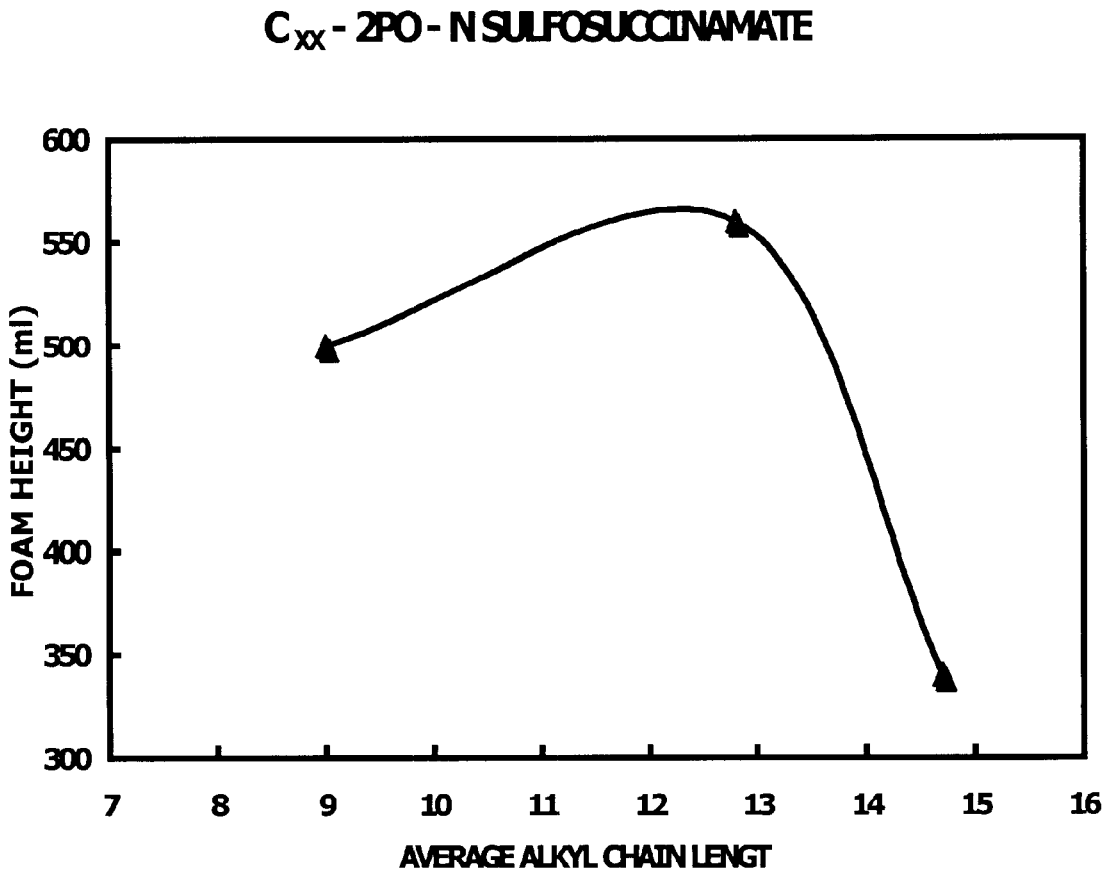
FIG. 1 shows foam heights of various sulfosuccinamate solutions after agitation in a Waring blender.

Sulfosuccinamates are a class of surfactant-type molecules whose preparation in the prior art is conducted by reacting an aliphatic primary amine in a first reaction step with maleic acid anhydride, thus:

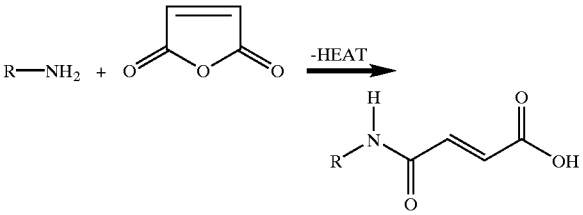

in order to form an unsaturated carboxylic acid possessive of an amide functionality, in which R is typically a $C_6$ to $C_{18}$ hydrocarbyl group. The unsaturation in the α-carbon of the resulting carboxylic acid may next be sulfonated using sodium bisulfite:

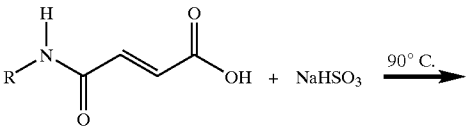

-continued

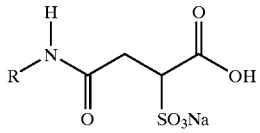

to provide a water-soluble sulfosuccinamate surfactant as the end product. However, one significant drawback of the prior art when using aliphatic amines as a reactant with maleic acid anhydride according to such a scheme is that unsaturated carboxylic acids produced in such reactions are solids at ordinary temperatures, which causes them to be difficult to handle and sluggish in their ability to solubilize in water. This is burdensome, since the bisulfite addition is typically done in aqueous media and undissolved solids do not sulfonate well from the standpoint of completion. In addition, the Krafft temperatures of the final resulting sulfosuccinamates of the prior art are relatively high, which means that their ability to form micelles and to thus effectively behave as surfactants is hindered under most conditions in which they might otherwise find use.

By our invention, we have discovered that using polyetheramines as reactants with maleic acid anhydride for the formation of the unsaturated carboxylic acid intermediate in the production of sulfosuccinamate surfactants unexpectedly affords a liquid product which is more easily handled than the analogous prior art intermediate made using aliphatic amines, which as mentioned above has heretofore been a solid product. Further, we have also discovered that sulfosuccinamate surfactants made by bisulfite addition to our polyetheramine-derived unsaturated carboxylic acid intermediate are possessed of a much lower Krafft temperature than are their analogous prior art sulfosuccinamate surfactants made using aliphatic amines. These benefits make the use of these materials attractive in various detergent formulations where the properties of the prior art materials were cost-prohibitive and cumbersome towards such uses. This is especially true when considered in conjunction with the unexpected physical properties of the materials, as mentioned further on.

According to one preferred form of the invention, a detergent range alcohol (one in which R has any number of carbon atoms in the range of between about $C_5$ to $C_{19}$ in the following formula) is reacted with an alkylene oxide:

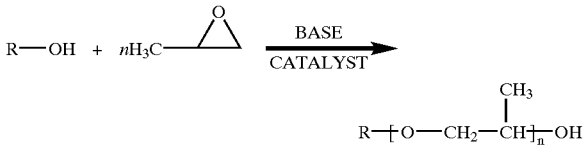

to yield an alkoxylated alcohol. This alkoxylated alcohol is next subject to amination, which causes the hydroxy group to be replaced by an amino group:

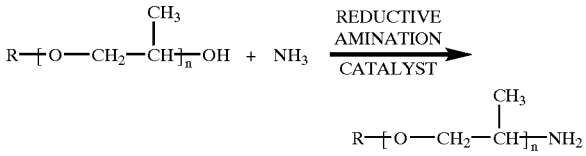

preferably, by the process of reductive amination, which is a process well known to those in this art. Although other methods of providing amines from such alcohols are known, including oxime reduction, Curtius, Schmidt, Ritter, Leuckart, and Hoffman reactions, reductive amination is most preferred owing to its economics of production. The amine product from the reaction immediately above is reacted with maleic acid anhydride to yield the corresponding unsaturated carboxylic acid, which may then undergo bisulfite addition to yield the sulfosuccinamate surfactant (I).

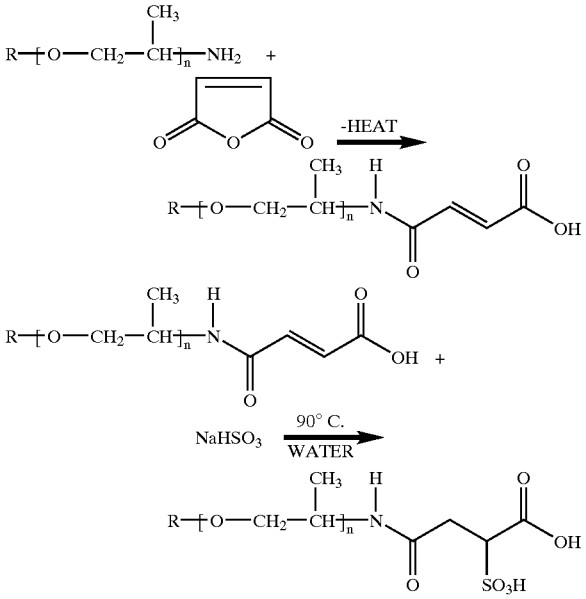

(I)

According to one preferred form of the invention, a $C_5$–$C_{19}$ alcohol, (and most typically a commercially-available mixture of several alcohols falling within this range,) is reacted with 2 moles of propylene oxide, and the resulting alcohol is subsequently caused to undergo reductive amination. The primary amine so formed is reacted with maleic acid anhydride to afford the monoamide, which is sulfonated using sodium bisulfite. The resulting products, exemplified by (1) above in their anionic forms in which n=2, are clear, low viscosity liquids having an actives content of about 30%.

According to the principles of this invention, it is possible to employ any alkoxylated amine as a reactant with maleic acid anhydride to provide an unsaturated carboxylic acid; provided that the amine comprises a nitrogen atom having at least one active hydrogen atom attached to the nitrogen atom. For purposes of this invention and the appended claims, an alkoxylated amine is any organic amine which has been reacted with an alkylene oxide selected from the group consisting of: ethylene oxide, propylene oxide, or butylene oxide to the extent that the product of such reaction includes at least one mole of an alkylene oxide in its molecular structure. For purposes of this invention, a hydrogen atom is considered to be an active hydrogen atom if it is capable of participating in the Zerevitinov reaction (Th. Zerevitinov, Ber. 40, 2023 (1907)) to liberate methane from methylmagnesium iodide. Such suitable materials include, without limitation, those available from Huntsman Petrochemical Corporation of Austin, Texas under the trade names JEFFAMINE® D-230; JEFFAMINE® D-400; JEFFAMINE® D-2000; JEFFAMINE® XTJ-502; JEFFAMINE® XTJ-505; JEFFAMINE® XTJ-506; JEFFAMINE® XTJ-507; JEFFAMINE® M-2070; JEFFAMINE® XTJ-510; and JEFFAMINE® EDR-148. However, the most preferred amine reactants to be reacted with maleic acid anhydride for producing an unsaturated carboxylic acid intermediate in accordance with the invention are those which are described by the general formula:

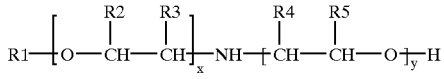

in which R1 may be any hydrocarbyl group, but is preferably an alkyl group containing between 5 and 19 carbon atoms, whether saturated or unsaturated, straight-chain, branched, or cyclic; R2 and R3 may each independently be: a hydrogen, or a hydrocarbyl group selected from the group consisting of: methyl and ethyl; x may be any integer between 1 and 20, including 1 and 20; R4 and R5 may each independently be: a hydrogen, or a hydrocarbyl group selected from the group consisting of: methyl and ethyl; and y is equal to 1. When using such amines as reactants with maleic anhydride, products represented by the formula:

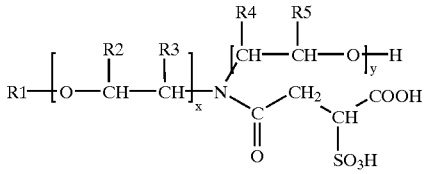

may be obtained in accordance with the reaction scheme given above in which R1 may be any hydrocarbyl group, but is preferably an alkyl group containing between 5 and 19 carbon atoms, whether saturated or unsaturated, straight-chain, branched, or cyclic; R2 and R3 may each independently be: a hydrogen, or a hydrocarbyl group selected from the group consisting of: methyl and ethyl; x may be any integer between 1 and 20, including 1 and 20; R4 and R5 may each independently be: a hydrogen, or a hydrocarbyl group selected from the group consisting of: methyl and ethyl; and y is equal to zero or 1. Although this formula represents a family of carboxylic acids, various alkali metal, alkaline earth metal, or other salts are readily obtainable from such materials by simple neutralization, as the derivation of such salts from materials containing a carboxylate function is well known to those in the organic chemistry art.

Preparation of Sulfosuccinamates

The preparation of sulfosuccinamates according to the present invention may be effected by charging to a reactor 18.25 grams of JEFFAMINE® C-300 and slowly adding 5.97 grams of maleic acid anhydride to the C-300 with gentle mixing. The reaction between the amine and anhydride is exothermic, and the mixing is continued for one hour, after which time the contents of the reactor are at about 80 degrees centigrade. The weights of the components may be adjusted to any desired level to provide a mono-amide product. 145.32 grams of such monoamide is added to 300.75 grams of de-ionized water and 90 grams of propylene glycol and stirred until homogeneous. The pH of the mixture is adjusted to 7.0 using 20% aqueous NaOH, and the mixture is heated to a temperature in the range of about 35 to 40 degrees centigrade, after which time 8.67 grams of sodium bisulfite is added to the mixture and the temperature raised to 100 degrees centigrade. Once the temperature has reached 100 degrees, an additional 26.04 grams of sodium bisulfite is added in small increments over the course of one hour, with gentle mixing. The reaction mixture is then cooled to room temperature to yield the sulfosuccinamate product. For producing other sulfosuccinamates, the same procedure is used, with the exception that the stoichiometric amount of the amine is adjusted to provide the reactants in the same proportion as above.

A systematic study was performed to determine the properties of the sulfosuccinamate surfactants produced in accordance with the invention as a function of alkyl chain length. All of the samples were based upon commercial Ziegler alcohols. Reaction product structures were confirmed using $C^{13}$ NMR. The anionic surfactant actives was determined using a 2-phase titration. The surfactant and physical properties are set forth below in Table 1:

TABLE 1

Experimental sulfosuccinamate Surfactants

| Sample | Alcohol | Moles PO | Appearance |
|---|---|---|---|
| 1 | $C_{6-10}$ | 2 | Clear, low viscosity |
| 2 | $C_{12-14}$ | 2 | Clear, low viscosity |
| 3 | $C_{14-16}$ | 2 | Clear, low viscosity |
| 4 | $C_{16-18}$ | 2 | RX gelled |

The foam potential of the surfactants was determined using a Waring blender (Model Number 31BL91) foam test. In this test, 200 ml of 1% aqueous solution of the surfactant was charged to the blender and mixed at low speed for 10 seconds. The contents of the blender are then transferred to a 500 ml graduated cylinder, and the foam volume measured. The foam height for a number of experimental sulfosuccinates is shown in FIG. 1.

From these chart performance data, it is evident that these materials are ideal for liquid dishwashing formulations where large volumes of foam are required, particularly when the alkyl chain length is kept below about 13 carbon atoms.

Hard Surface Cleaner Performance

The hard surface cleaning performance of the sulfosuccinamates of the present invention was determined by comparing the optical reflectance of white vinyl tiles treated with an exemplary test soil before and after cleaning. The test soil is one which is prepared in accordance with testing procedure ASTM D-4488, section A6.4.3, by adding the following ingredients in the indicated order and then mixing for 30 minutes:

TABLE 2

Soil Preparation ASTM (D-4488)

| Ingredient | Grams |
|---|---|
| Paint Thinner | 50 |
| Vegetable oil | 4 |
| Mineral oil | 10 |
| Clay | 10 |
| Carbon Black | 4.5 |

In practice of the testing, the soil composition was applied to vinyl tiles by paintbrush, and the soiled tiles were then heat treated at 60° C. for one hour. Three vinyl tiles for each sample were cleaned with 0.1% solutions of the test sulfosuccinamate at room temperature, using a Gardner scrubber apparatus (model KAB 5115) for 20 strokes. The tiles were then rinsed with water containing 150 ppm hardness. Cleaning efficiency was determined from reflectance readings obtained from a Hunter "LABSCAN XE" Color Quest Reflectometer which were taken before soiling, after soiling, and after cleaning. Soil removal was calculated as a percentage using the following formula:

$$SR\% = (R_w - R_s)/(R_0 - R_s)*100$$

where $R_w$=Reflectance of tiles after cleaning;

$R_s$=Reflectance of tiles before cleaning; and $R_0$=Reflectance of tiles before soiling.

Figure 2:
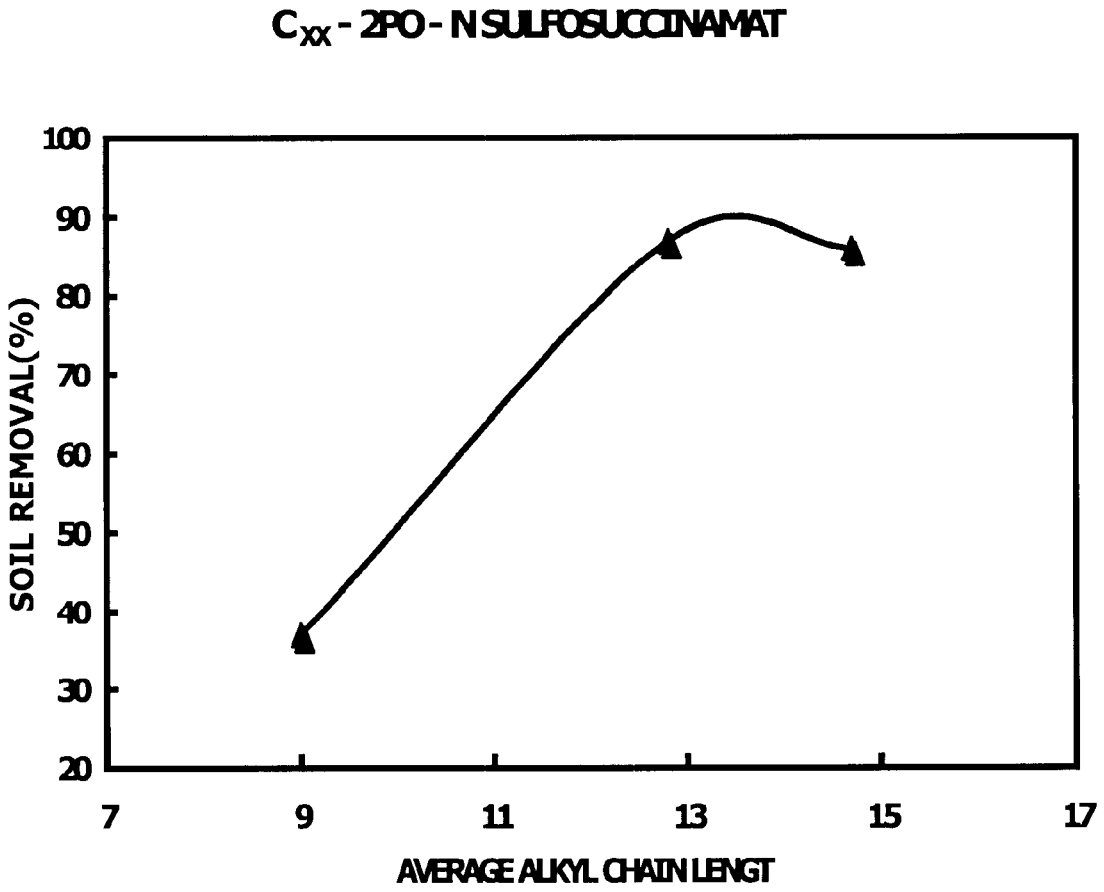
FIG. 2 shows hard surface cleaning perfonnance of various sulfosuccinamate solutions.
Figure 3:
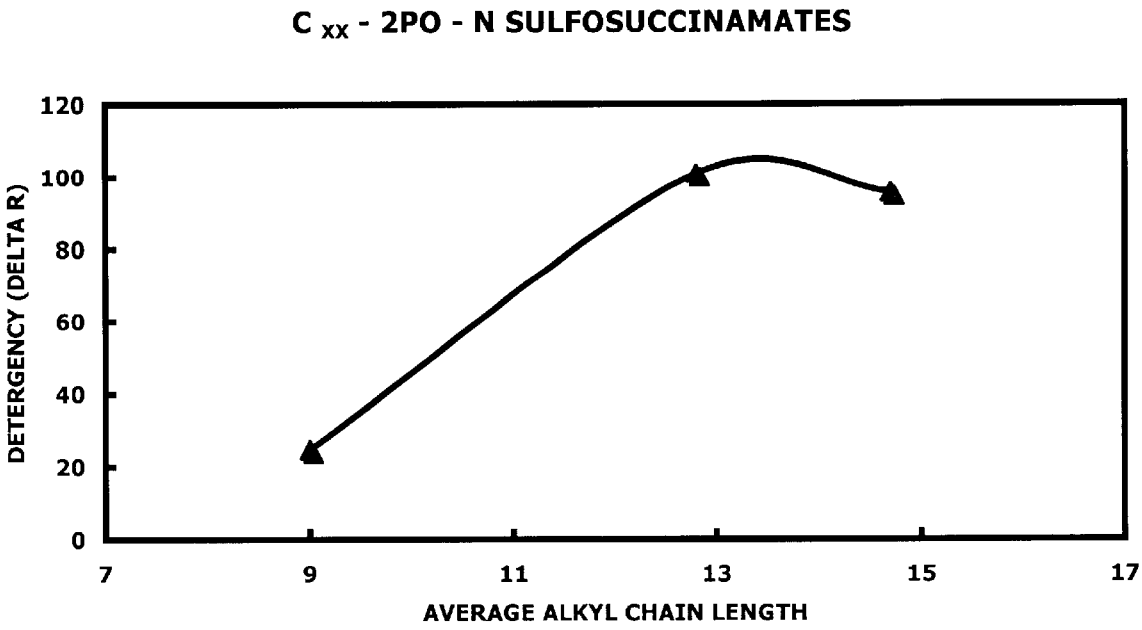
FIG. 3 shows laundry detergency performance of various sulfosuccinamate solutions.

Comparative percent soil removal is depicted in FIG. 2, for the di-sodium salt of the sulfosuccinamate having the formula:

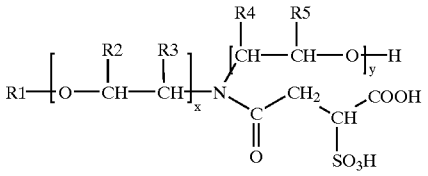

in which R1 is derived from a $C_{12}$–$C_{14}$ alcohol mixture; x=2; R2 is H, and R3 is methyl and y=0:

Thus the $C_{12-14}$ and $C_{14-16}$ sulfosuccinamates show excellent soil removal properties making them particularly useful as hard surface cleaners. They further show very little streaking or film formation on the surface, making them excellent surfactants for cleaning of glass and tile.

Laundry Detergent Performance

The performance of the sulfosuccinamate in laundry detergency was also determined. All tests were performed in a Terg-O-Tometer using standard soil cloth swatches at 150 ppm hard water and 100° F. The optical reflectance of the cloth swatches is measured before and after cleaning, and the change in reflectance used as a measure of cleaning performance. Each soil and fabric type was washed in triplicate, and the results were averaged to give a more representative result. The comparative total cleaning performance obtained by summing over all soil and fabric types is shown in Graph 3 for the same sodium salt as used in the hard surface cleaning tests:

Thus, the $C_{12-14}$ sulfosuccinamates have been observed to show excellent cleaning performance properties in laundry applications as well. Following are typical formulations which employ the sulfosuccinamates of this invention, although any formulation for laundry detergent may have its surfactant replaced in whole or in part by a sulfosuccinamate according to the invention. All parts are parts by weight.

Liquid Dishwashing Liquid Formulations

| | |
|---|---|
| Formula #1 | |
| Sodium lauryl ether sulfate (70%) | 28.5 |
| Sulfonic acid, Huntsman LAS 225 | 22.8 |
| NaOH (50%) | 7.2 |
| TEA (99%) | — |
| C1214-2PO-N-Sulfosuccinamate | 5 |
| Water | 36.5 |
| Formula #2 | |
| Sodium lauryl ether sulfate (70%) | 28.5 |
| Sulfonic acid, Huntsman LAS 225 | 18 |

-continued

| Liquid Dishwashing Liquid Formulations | |
|---|---|
| NaOH (50%) | — |
| TEA (99%) | 8.4 |
| C1214-2PO-N-Sulfosuccinamate (13% actives) | 5–30 |
| Water | sufficient to make 100 grams |

| Hard Surface Cleaner | |
|---|---|
| $C_{12-14}$-2PO-N-Sulfosuccinamate (30% actives content) | 1 |
| IPA | 5 |
| NH4OH (30%) | 0.2 |
| N-butyl ether | 1 |
| Water | 92.8 |

| Laundry Detergent | |
|---|---|
| HDL-30 | 8.00 |
| Sulfosuccinamate (18% actives) | 5.50 |
| TINAPOL CBS-X (CIBA) | 0.10 |
| ACUSOL 445N (Rohm & Haas) | 0.50 |
| Fragrance | 0.05 |
| Dye | 0.002 |
| Water | sufficient to make 100 grams total |

Figure 4:
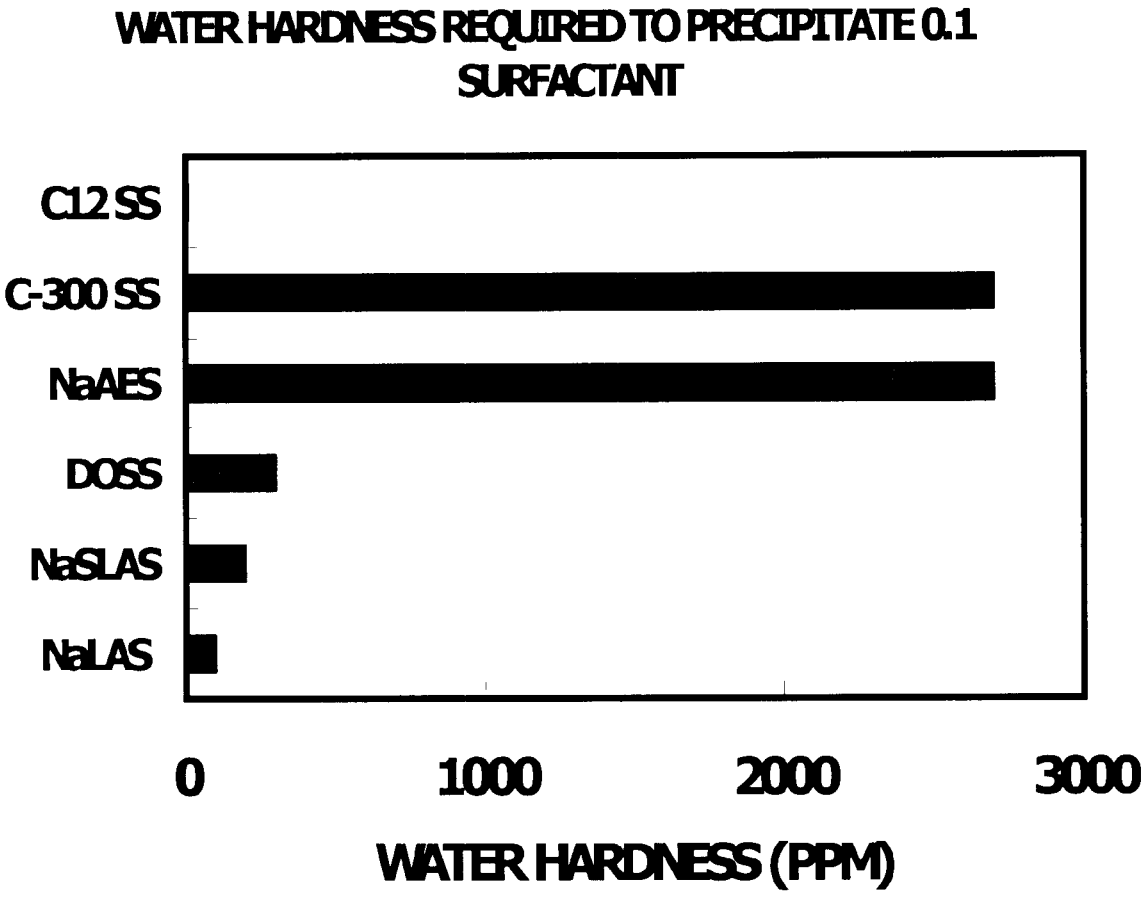
FIG. 4 shows water hardness tolerance of various surfactants, including the sulfosuccinamates of the present invention.

The sulfosuccinamates according to the invention were also observed to exhibit an unexpectedly high tolerance to water hardness. Table 3 sets forth the amount of water hardness which must be present in order to cause formation of a visible precipitate in a 0.10% (wt.) solution of various surfactants, which data are depicted in FIG. 4. The first surfactant is a prior art surfactant, which is the sulfosuccinamate prepared from a $C_{12-14}$ primary amine mixture ARMEEN C available from Akzo Nobel in Stenungsuyo Sweden. The second surfactant is the sulfosuccinamate prepared in accordance with the invention using JEFFAMINE® C-300 polyetheramine, available from Huntsman Petrochemical Corporation of Austin, Texas. The third surfactant is a sodium alkylethersulfate, CALIFOAM ES-303 available from Pilot Chemical Company a material which is well known in the art to be especially tolerant of high water hardness. The fourth surfactant is a di-octly sulfosuccinamide DOS 75P6 available from Huntsman Petrochemical Corporation. The fifth material is a sodium alkylbenzene sulfonate having a high 2-isomer content, which has been disclosed in another patent application as having enhanced water hardness tolerance relative to commercially available alkylbenzene sulfonates. The last surfactant is a commercially available sodium alkylbenzene sulfonate (designated as A225 and available from Huntsman Petrochemical Corporation of Austin, Tex.). As these data show, sulfosuccinamates prepared according to the invention using polyetheramines exhibit extraordinary water hardness (total Ca+Mg, present in a ratio of 2:1 with respect to each other) tolerance with respect to some of the most popular and widely used surfactants. Since most water around the world contains various amounts of total water hardness, precipitation by the presence of water hardness minerals of active surfactant molecules leads to a decrease in the effective amount of total active surfactant available, which leads to a lower cleaning property. By the invention, surfactant-bearing formulations may be made which do not lose their effectiveness even in water containing the highest naturally-occurring levels of hardness, which is about 1300 ppm.

TABLE 3 amount of water hardness needed to cause visible precipitate in 0.10% (wt.) solution of various surfactants.

| Surfactant | Hardness required for Precipitation (ppm) |
|---|---|
| $C_{12}$ sulfosuccinamate | 10 |
| C-300 sulfosuccinamate | 2700 |
| Na alkylethersulfate | 2700 |
| di-octyl sulfosuccinamide | 300 |
| Na LAB (80% 2-φ isomer) | 200 |
| Na LAB (18% 2-φ isomer) | 100 |

The sulfosuccinamates described in the structures above are believed to be useful in all finished formulations of cleaning products which employ one or more surfactants. Thus, they are useful in formulations which contain a material which is known to those skilled in the art as being useful in formulating soaps, detergents, and the like. For purposes of this invention, the words "material known to those skilled in the art as being useful in formulating soaps, detergents, and the like" means at least one of: fatty acids, alkyl sulfates, an ethanolamine, an amine oxide, alkali carbonates, water, ethanol, isopropanol, pine oil, sodium chloride, sodium silicate, polymers, alcohol alkoxylates, zeolites, perborate salts, alkali sulfates, enzymes, hydrotropes, dyes, fragrances, preservatives, brighteners, builders, polyacrylates, essential oils, alkali hydroxides, ether sulfates, alkylphenol ethoxylates, fatty acid amides, alpha olefin sulfonates, paraffin sulfonates, betaines, chelating agents, tallowamine ethoxylates, polyetheramine ethoxylates, ethylene oxide/propylene oxide block copolymers, alcohol ethylene oxide/propylene oxide low foam surfactants, methyl ester sulfonates, alkyl polysaccharides, N-methyl glucamides, alkylated sulfonated diphenyl oxide, and water soluble alkylbenzene sulfonates or alkyltoluene sulfonates, as the use of such in formulating soaps, detergents, and the like are known in the art.

The most preferred sulfosuccinamate prepared in accordance with the present invention is one which is made from the propoxylation of a mixture of alcohols having between 12 and 14 carbon atoms such as SURFOL® 1214 available from Huntsman Petrochemical Corporation), which propoxylated alcohol mixture is subsequently subjected to reductive amination to afford the amine intermediate, which may then be reacted with maleic anhydride and finally sulfonated to yield a surfactant product according to the invention. It is most preferred that such propoxylation be undertaken to such a degree that the predominant amount of propylene oxide incorporated into each mole of alcohol is 2 moles of propylene oxide. Thus, an especially preferred sulfosuccinamate according to the invention is represented by the structure:

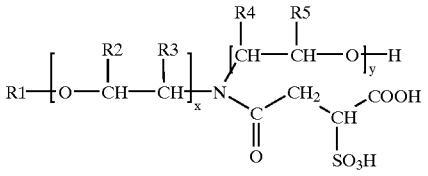

in which x=2; R2 is methyl or hydrogen; R3 is methyl or hydrogen; and y=0.

It is possible during the alkoxylation of the alcohol during preparation of a polyetheramine in accordance with the present invention to employ successive stages of alkoxylation in which two or more different alkylene oxides are employed using either a mixture comprising a plurality of alkylene oxides in a single stage, or successive stages of alkoxylation in which a single alkylene oxide is employed in each stage. When successive stages of alkoxylation are used, it is possible to obtain a finished molecule with a block portion of each alkylene oxide used, wherein each block portion consists of a chain of several monomers of a particular alkylene oxide. When a mixture of alkylene oxides are used in the alkoxylation, the alkylene oxide chain in the finished molecule contains a random distribution of each alkylene oxide used. One particularly useful class of compounds are described by the general formula:

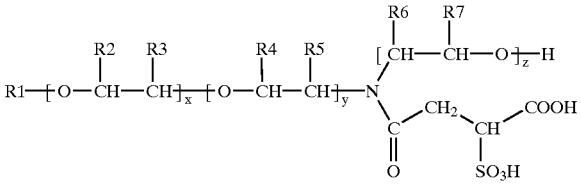

in which R1 is a hydrocarbyl group containing between 5 and 19 carbon atoms, saturated or unsaturated, straight-chain, branched, or cyclic, R2 and R3 and R4 and R5 may each independently be a hydrogen, or a hydrocarbyl group selected from the group consisting of: methyl and ethyl; x and y may be any integer between 1 and 10 including 1 and 10; R6 and R7 may each be independently a hydrogen, or a hydrocarbyl group selected from the group consisting of: methyl and ethyl; and z is independently equal to zero or one. Because reaction with bisulfite ion may occur at either carbon atom in the double bond of the polyetheramine/maleic anhydride reaction product during sulfonate formation, materials of the following structure are also produced, more or less in the sulfonation reaction:

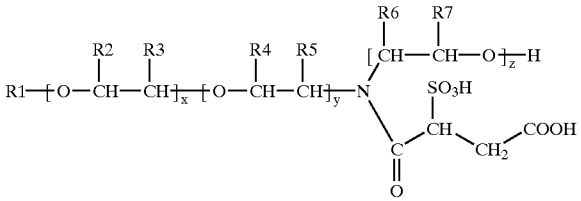

in which R1 is a hydrocarbyl group containing between 5 and 19 carbon atoms, saturated or unsaturated, straight-chain, branched, or cyclic, R2 and R3 and R4 and R5 may each independently be a hydrogen, or a hydrocarbyl group selected from the group consisting of: methyl and ethyl; x and y may be any integer between 1 and 10 including 1 and 10; R6 and R7 may each be independently a hydrogen, or a hydrocarbyl group selected from the group consisting of: methyl and ethyl; and z is independently equal to zero or one.

Although the formulae depicted herein for the sulfosuccinamate products are shown in their acid forms which comprise both a sulfonic acid and a carboxylic acid functionality, the actual materials used are the water soluble salts. Suitable water soluble salts for use include the alkali metal and ammonium salts, with the only proviso is that the salt must be water soluble. Neutralization of such acids is well known in the art using hydroxides, oxides, or carbonates of the desired metal as slurries or in aqueous solution. Most commonly, the metal will be sodium, and the final material employed will be the di-sodium salt of the sulfosuccinamate, although mono salt neutralization products are also within the scope of the invention. Suitable metals are: lithium, sodium, potassium, and rubidium. Neutralization of a di-acid produced in accordance with the invention with ammonium hydroxide affords water-soluble ammonium salts.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow.

We claim:

1. A composition of matter useful as a surfactant in finished formulations for cleaning dishes, hard surfaces, and laundry, comprising an anionic form of a material described by the formula:

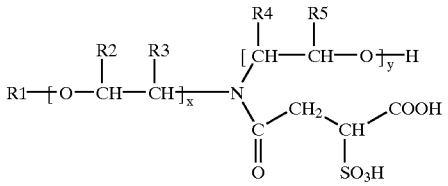

in which R1 is a hydrocarbyl group containing between 5 and 19 carbon atoms, saturated or unsaturated, straight-chain, branched, or cyclic; $R_2$ and $R_3$ may each independently be a hydrogen, or a hydrocarbyl group selected from the group consisting of: methyl and ethyl; x may be any integer between 7 and 20, including 7 and 20; $R_4$ and $R_5$ may each independently be a hydrogen, or a hydrocarbyl group selected from the group consisting of: methyl and ethyl; and y is independently equal to zero or 1.

2. A composition according to claim 1 further comprising at least one material known to those skilled in the art as being useful in formulating soaps, detergents, and the like.

3. A composition according to claim 1 wherein y=0; x is independently any integer selected from the group consisting of 1, 2, 3, 4, 5, and 6; one and only one of $R_2$ or $R_3$ is independently selected from the group consisting of: methyl and ethyl; and the remaining group $R_2$ or $R_3$ which is not methyl or ethyl is H.

4. A composition according to claim 1 wherein y=0; x is independently any integer selected from the group consisting of 1, 2, 3, 4, 5, and 6; one and only one of $R_2$ or $R_3$ is independently selected from the group consisting of: methyl and ethyl; and the remaining group $R_2$ or $R_3$ which is not methyl or ethyl is H.

5. A composition according to claim 1 wherein y=0; x is any integer selected from the group consisting of: 2 and 3; $R_3$ is selected from the group consisting of: methyl and ethyl; and $R_2$ is H.

6. A composition according to claim 1 wherein $R_4$ and $R_5$ are each H; y=1; x is any integer selected from the group consisting of 1, 2, 3, 4, 5, and 6; one and only one of $R_2$ or $R_3$ is selected from the group consisting of: methyl and ethyl; and the remaining group $R_2$ or $R_3$ which is not methyl or ethyl is H.

7. A finished formulation selected from the group consisting of: laundry detergents, dishwashing detergents, and hard surface cleaners which comprises a composition according to claim 1.

8. A formulation according to claim 7 which shows no precipitation due to water hardness minerals when the total water hardness is any ppm level in the range of between 50 ppm and 1200 ppm.

9. A composition according to claim 1 in which charge balance for said anionic form is provided by at least one cation selected from the group consisting of: lithium, potassium, sodium, rubidium, and ammonium.

* * * * *